US006685389B1

(12) United States Patent
Christensen et al.

(10) Patent No.: US 6,685,389 B1
(45) Date of Patent: Feb. 3, 2004

(54) MACHINE FOR AUTOMATICALLY REMOVING THE PROTECTIVE COVERINGS FROM TEMPORARY RAISED PAVEMENT MARKERS (TRPMS)

(75) Inventors: Michael Christensen, Parkers Prairie, MN (US); John Glawe, Alexandria, MN (US); Chad Orthaus, Alexandria, MN (US); Jeffrey Arnold Wilkens, Reiles Acres, ND (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 10/247,438

(22) Filed: Sep. 20, 2002

(51) Int. Cl.[7] ..... E01C 23/00
(52) U.S. Cl. ..... 404/72; 404/84.05; 404/12
(58) Field of Search ..... 299/39.1, 39.2, 299/41.1; 404/85, 86, 112, 93, 94, 72, 84.05

(56) References Cited

U.S. PATENT DOCUMENTS

| | | | | |
|---|---|---|---|---|
| 1,766,073 A | | 6/1930 | Hartzler et al. | |
| 1,833,124 A | | 11/1931 | Rand | |
| 3,380,428 A | | 4/1968 | Abrams | |
| 3,963,362 A | | 6/1976 | Hollis | |
| 4,111,581 A | | 9/1978 | Auriemma | |
| 4,445,803 A | | 5/1984 | Dixon | |
| 4,521,129 A | | 6/1985 | Krech et al. | |
| 4,534,673 A | | 8/1985 | May | |
| 4,542,709 A | | 9/1985 | Spaugh | |
| 4,645,168 A | | 2/1987 | Beard | |
| 4,991,994 A | | 2/1991 | Edouart | |
| 5,027,906 A | * | 7/1991 | Jeannotte et al. | 171/86 |
| 5,213,464 A | * | 5/1993 | Nicholson et al. | 414/440 |
| 5,327,850 A | | 7/1994 | Sly et al. | |
| 5,392,728 A | | 2/1995 | Speer et al. | |
| 5,393,166 A | | 2/1995 | Stock et al. | |
| 5,460,115 A | | 10/1995 | Speer et al. | |
| 5,515,807 A | | 5/1996 | Speer et al. | |
| 5,605,381 A | * | 2/1997 | Schmoock et al. | 299/39.2 |
| 5,775,781 A | * | 7/1998 | Sawtelle et al. | 299/39.8 |
| 5,788,405 A | | 8/1998 | Beard | |
| 5,853,263 A | * | 12/1998 | Green | 404/94 |
| 5,882,086 A | * | 3/1999 | Bremner et al. | 299/41.1 |
| 5,890,772 A | * | 4/1999 | Mravyan | 299/41.1 |
| 5,934,822 A | * | 8/1999 | Green | 404/94 |
| 6,042,299 A | * | 3/2000 | Cooper | 404/83 |
| 6,109,820 A | | 8/2000 | Hughes, Sr. | |

FOREIGN PATENT DOCUMENTS

| | | | | |
|---|---|---|---|---|
| GB | 2362671 A | * | 11/2001 | E01C/23/08 |
| WO | WO95/2731 | | 1/1995 | |

* cited by examiner

*Primary Examiner*—Robert E. Pezzuto
*Assistant Examiner*—Alexandra K. Pechhold
(74) *Attorney, Agent, or Firm*—Schwartz & Weinrieb

(57) ABSTRACT

Apparatus for removing protective coverings from temporary raised pavement markers (TRPM) fixedly secured upon roadway surfaces comprises a platform, and a plurality of toothed implements disposed beneath the platform for encountering and removing the protective coverings mounted upon the upstanding vertical reflective portions of the temporary raised pavement markers (TRPM). The toothed implements are mounted upon a chain which is driven by a motor mounted upon an upper surface portion of the platform, and a blower is also mounted upon the upper surface portion of the platform. An exhaust duct, fluidically connected to the intake side of the blower, passes through a suction port defined within the platform so as to be fluidically connected to the underside of the platform, and in this manner, the removed protective coverings of the temporary raised pavement markers (TRPM) may be removed from the roadway surface and conveyed to a suitable debris collection bag.

23 Claims, 5 Drawing Sheets

MACHINE FOR AUTOMATICALLY REMOVING THE PROTECTIVE COVERINGS FROM TEMPORARY RAISED PAVEMENT MARKERS (TRPMS)

FIELD OF THE INVENTION

The present invention relates generally to temporary raised pavement markers (TRPMs) which are adapted to be fixedly secured to roadway surfaces in order to, for example, temporarily define traffic lanes or the like, and more particularly to a new and improved machine for automatically removing the protective coverings from the temporary raised pavement markers (TRPMs) in order to in fact ready the temporary raised pavement markers (TRPMs) for actual traffic use upon the roadway surfaces.

BACKGROUND OF THE INVENTION

Various types of roadway markers have been utilized in connection with a variety of traffic control applications. Many roadway markers are adapted to be permanently attached or secured to the road surface so as to permanently delineate traffic lanes upon the roadway, while other roadway markers are adapted to be temporarily attached or secured to particular road surfaces in order to temporarily delineate traffic lanes within construction zones or other work areas. Accordingly, the latter type of roadway markers are known as temporary roadway markers and are usually attached or secured to the road surface by means of a suitable adhesive that can retain the roadway marker in its place upon the road surface during the temporary life of the roadway marker. More particularly, temporary roadway markers can serve, for example, as a means for identifying edge portions of the roadway, or alternatively, to delineate traffic lane lines and thereby demarcate separate lanes of traffic from each other in and around construction sites and other work zones. After the construction or other road work is completed, the temporary roadway markers are to be removed.

To be effective, the temporary roadway markers must clearly be capable of alerting motorists to the fact that they are nearing or entering a construction zone or work area, and therefore, the temporary roadway markers must in fact be effective both during daytime hours, nighttime hours, sunny conditions, cloudy conditions, inclement weather conditions, and the like. More particularly, one type of temporary roadway marker that has been extremely successful or effective in providing short-term temporary markings upon roadways both during daytime and nighttime hours, and which has also been able to adequately withstand the various im-pact forces that are normally impressed thereon by daily roadway vehicular traffic so as to in fact provide the desired service life required in connection with the installation of such temporary roadway markers, has been that type of temporary roadway marker which is known in the industry as a temporary raised pavement marker (TRPM). Examples of such temporary raised pavement markers (TRPMs) are disclosed, for example, within U.S. Pat. No. 6,109,820 which issued to Hughes, Sr. on Aug. 29, 2000, U.S. Pat. No. 5,788,405 which issued to Beard on Aug. 4, 1998, U.S. Pat. No. 5,460,115 which issued to Speer et al. on Oct. 24, 1995, U.S. Pat. No. 4,991,994 which issued to Edouart on Feb. 12, 1991, and U.S. Pat. No. 4,445,803 which issued to Dixon on May 1, 1984.

As can readily be appreciated from FIG. 1, which corresponds substantially to FIG. 1 of the Speer et al. patent, it is briefly noted that an exemplary temporary raised pavement marker (TRPM) 10 is seen to have a substantially L-shaped configuration wherein the horizontally disposed leg portion 12 thereof is adapted to be fixedly secured or attached to the road surface by means of a suitable adhesive which is allowed to set, while the vertically upstanding leg portion 14 is adapted to be visually seen by the oncoming motorist. A transition region 26 flexibly interconnects the vertically upstanding leg portion 14 to the fixed leg portion or base member 12. A pair of rib members or ledges 28,28 extend substantially perpendicular to the upstanding leg member 14 and serve to define a space or channel 22 therebetween. A suitable reflective strip 23 is adapted to be fixedly disposed within the space or channel 22 so as to reflect sunlight or a vehicle's lights in order to provide the oncoming motorist, as indicated by the arrow 25, with a visual indication that the motorist is approaching or entering a construction zone or work area. Alternatively, in lieu of the reflective strip 23, the entire marker 10 may simply be brightly colored so as to similarly provide the oncoming motorist with the necessary visual warning.

With reference being further made to FIG. 2, a temporary raised pavement marker (TRPM), which is similar to the temporary raised pavement marker (TRPM) 10 disclosed in FIG. 1 of the present drawings as well as within FIG. 1 of the Speer et al. patent, is disclosed at 110 and is seen to likewise have a substantially L-shaped configuration. In particular, the temporary raised pavement marker (TRPM) 110 comprises a horizontally disposed leg or base member 112, and a vertically upstanding leg member 114 integrally connected to the horizontally disposed leg or base member 112 by means of a transitional region 116. An adhes-ive pad 118 is fixedly secured to an undersurface or lower face portion of the horizontally disposed leg or base member 112, and in turn a release sheet 120 is secured to an under-surface or lower face portion of the adhesive pad 118 so as to prevent the adhesive pad 118 from being inadvertently adhesively bonded to any surface, other than that particular location or portion of the roadway to which the temporary raised pavement marker (TRPM) 110 is to be fixedly secured, prior to the actual fixation of the temporary raised pavement marker (TRPM) 110 upon a selected location or portion of the roadway. As was the case with the temporary raised pavement marker (TRPM) 10 of FIG. 1 of the present drawings as well as those of Speer et al., the upper end portion of the vertically upstanding leg member 114 of the temporary raised pavement marker (TRPM) 110 also comprises a pair of horizontally disposed rib members 122,122 which define a space or channel 124 therebetween for housing or accommodating a suitable reflector strip, not shown. Alternatively, the entire extrusion comprising the temporary raised pavement marker (TRPM) 110 may be fabricated from a suitable plastic material which is brightly colored, that is, it may be fabricated from a suitable resin material which is white or yellow.

The temporary raised pavement markers (TRPM) 110 are normally placed upon the roadway surface during an extended period of time that construction or other road work is being performed upon the roadway surface, and therefore prior to the completion of the entire construction or other road work as well as the application of the permanent traffic lane lines to the roadway surface. Accordingly, in order to protect the reflector strip, not shown, which is adapted to be disposed, housed, or accommodated within the space or channel 124 defined between the pair of horizontally disposed rib members 122,122, or alternatively, in order to protect the upper portion of the vertically upstanding leg member 114 when such portion of the temporary raised pavement marker (TRPM) 110 is to be used as the visual warning to on-coming motorists, from road paving materials, debris, and the like, a protective cover 126, fabricated from a suitable clear plastic material and having a substantially inverted U-shaped configuration, is disposed over the upper free edge portion of the temporary raised pavement marker (TRPM) 110. When the temporary raised pavement markers (TRPM) 110 are to be subsequently used in conjunction with, for example, their traffic lane delineation functions, the protective covers 126 must be removed, and still further, when the need for the temporary raised pavement markers (TRPM) 110 is no longer required in view of the completion of the construction or other roadwork, and the application of the permanent traffic lane lines to the roadway surface, the temporary raised pavement markers (TRPM) 110 must also be removed from the roadway surface. Until now, such removal processes were accomplished manually whereby construction workmen or other personnel would have to manually remove the protective covers 126 and subsequently sever or otherwise remove the temporary raised pavement markers (TRPM) 110 from the roadway surface. Obviously, such procedures are quite tedious and time-consuming. In addition, in view of the fact that the construction workmen or other personnel need to be physically present upon the particular roadway surface during the performance of such protective cover and temporary raised pavement marker (TRPM) removal operations, the workmen or personnel are unnecessarily exposed to dangerous vehicular conditions present upon the roadway.

A need therefore exists in the art for a new and improved device, machine, or apparatus for automatically removing the protective covers from the temporary raised pavement markers (TRPM) disposed upon the roadway surfaces, whereby the temporary raised pavement markers (TRPM) can be used for their traffic line, delineation, or demarcation purposes, whereby the protective covers can be removed from the temporary raised pavement markers (TRPM) disposed upon the roadway surfaces in a relatively rapid manner, whereby the construction workmen or other operator personnel do not need to tediously perform such removal operations manually, and in addition, and just as importantly, whereby the operator personnel or construction workers will not be needlessly exposed to dangerous roadway conditions presented by oncoming automotive vehicular traffic.

OBJECTS OF THE INVENTION

Accordingly, it is an object of the present invention to provide a new and improved device or apparatus for automatically removing the protective covers from temporary raised pavement markers (TRPM) adhesive bonded to roadway surfaces.

Another object of the present invention is to provide a new and improved device or apparatus for automatically removing the protective covers from temporary raised pavement markers (TRPM) adhesively bonded to roadway surfaces whereby the operational drawbacks and disadvantages characteristic of the PRIOR ART techniques currently employed for removing the protective covers from the temporary raised pavement markers (TRPM) are effectively overcome.

An additional object of the present invention is to provide a new and improved device, machine, or apparatus for removing the protective covers from the vertically upstanding leg members of temporary raised pavement markers (TRPM) adhesively bonded to roadway surfaces wherein the protective covers of the temporary raised pavement markers (TRPM) can be automatically removed from the temporary raised pavement markers (TRPM).

A further object of the present invention is to provide a new and improved device or apparatus for removing the protective covers from temporary raised pavement markers (TRPM) adhesively bonded to roadway surfaces wherein the protective covers of the temporary raised pavement markers (TRPM) can be automatically removed from the temporary raised pavement markers (TRPM) such that construction workers or other operator personnel do not have to manually remove such protective covers from the temporary raised pavement markers (TRPM) in a tedious and relatively slow manner.

A last object of the present invention is to provide a new and improved device or apparatus for removing the protective covers from the temporary raised pavement markers (TRPM) adhesively bonded to roadway surfaces wherein the protective covers of the temporary raised pavement markers (TRPM) can be automatically removed from the temporary raised pavement markers (TRPM) such that the construction workers or other operator personnel do not have to manually remove such protective covers from the temporary raised pavement markers (TRPM) and thereby not be unnecessarily exposed to dangerous roadway conditions presented by oncoming automotive vehicular traffic.

SUMMARY OF THE INVENTION

The foregoing and other objectives are achieved in accordance with the teachings and principles of the present invention through the provision of a new and improved device, machine, or apparatus for automatically removing the protective covers from the vertically oriented leg members of temporary raised pavement markers (TRPM), adhesively bonded to the roadway surfaces, which comprises a platform upon the front end of which a mounting plate is bolted or otherwise fastened for rotatably supporting a pair of front wheel assemblies. A pair of trailer hitch bracket assemblies are also fixedly secured upon the mounting plate so as to permit the device, machine, or apparatus to be towed by means of a roadwork vehicle or truck. A plurality of combs, each having a plurality of teeth integrally formed thereon, are mounted upon a drive chain which is rotatably disposed beneath a forward end portion of the platform and which is adapted to encounter and remove the protective covers disposed upon the vertically oriented leg members of the temporary raised pavement markers (TRPM). The chain drive and toothed combs are adapted to be driven by means of a suitable drive motor, mounted upon an upper surface portion of the platform, and a pair of sprockets operatively engaged with the drive chain.

A blower is also mounted upon an upper surface portion of the platform, and an intake or suction duct, fluidically connected to the intake side of the blower, passes through a rear end portion of the platform so as to be fluidically connected to a suction or intake port defined within the underside of the platform. In this manner, the protective covers removed from the upper reflective portions of the vertically upstanding leg members of the temporary raised pavement markers (TRPM) may be conveyed to a suitable debris collection bag or container. In conjunction with the collection and removal of the severed portions of the temporary raised pavement markers (TRPM), a plurality of brushes are arranged in a substantially continuous manner around substantially the entire periphery of the platform, except for the front end portion thereof, so as to effectively form or define a dependent curtain which extends vertically downwardly from the lower edge portion of the platform for operative engagement with the roadway surface as the device, apparatus, or machine is moved along the roadway surface. In addition, the platform, and therefore the brush curtain, has a convergent or tapered configuration, as considered in the direction extending from the front end portion thereof to the rear end portion thereof, and therefore, the protective covers removed from the vertically upstanding reflective portions of the temporary raised pavement markers (TRPM) are automatically funneled or herded toward the suction intake duct operatively associated with the blower so as to be accordingly removed and discharged into the collection bin or container.

BRIEF DESCRIPTION OF THE DRAWINGS

Various other objects, features, and attendant advantages of the present invention will be more fully appreciated from the following detailed description when considered in connection with the accompanying drawings in which like reference characters designate like or corresponding parts throughout the several views, and wherein.

DETAILED DESCRIPTION OF THE PREFERRED EMBODIMENT

Figure 1:
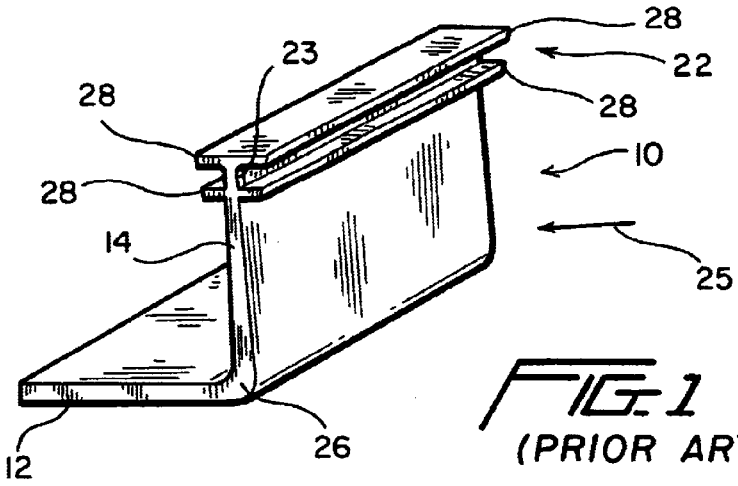
FIG. 1 (PRIOR ART)
FIG. 1 is a perspective view of a conventional PRIOR ART temporary raised pavement marker (TRPM)
Figure 2A:
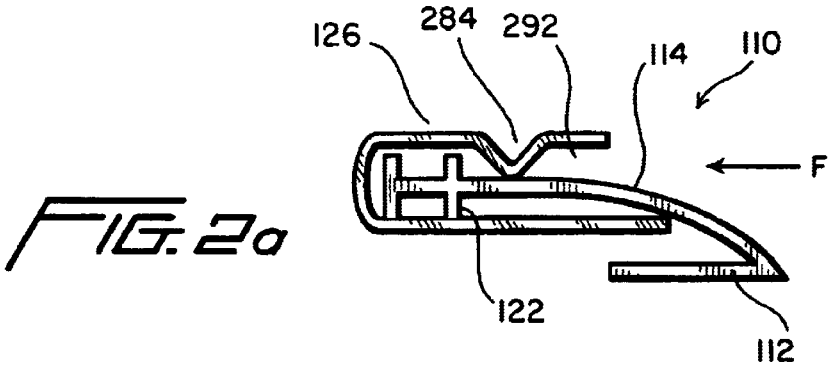
FIG. 2*a* is a schematic view of the temporary raised pavement marker (TRPM) as shown in FIG. 2 illustrating the spatial disposition of the protective cover with respect to the vertically upstanding leg member of the temporary raised pavement marker (TRPM) as the vertically upstanding leg member of the temporary raised pavement marker (TRPM) is deflected downwardly so as to permit the toothed comb implements of the machine or apparatus of the present invention to subsequently separate and remove the protective cover from the vertically upstanding leg member of the temporary raised pavement marker (TRPM)
Figure 2:
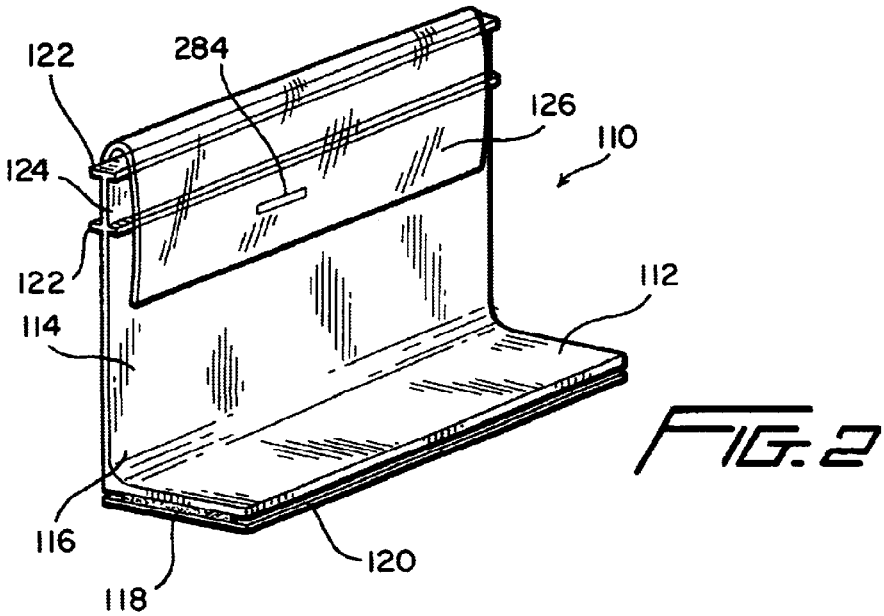
FIG. 2 is a perspective view of a temporary raised pavement marker (TRPM) of the type which has a protective cover disposed upon the vertically upstanding leg member thereof and which is adapted to be removed from the temporary raised pavement marker (TRPM), adhes-ively bonded to the roadway surface, by means of the device, machine, or apparatus constructed in accordance with the principles and teachings of the present invention.
Figure 3:
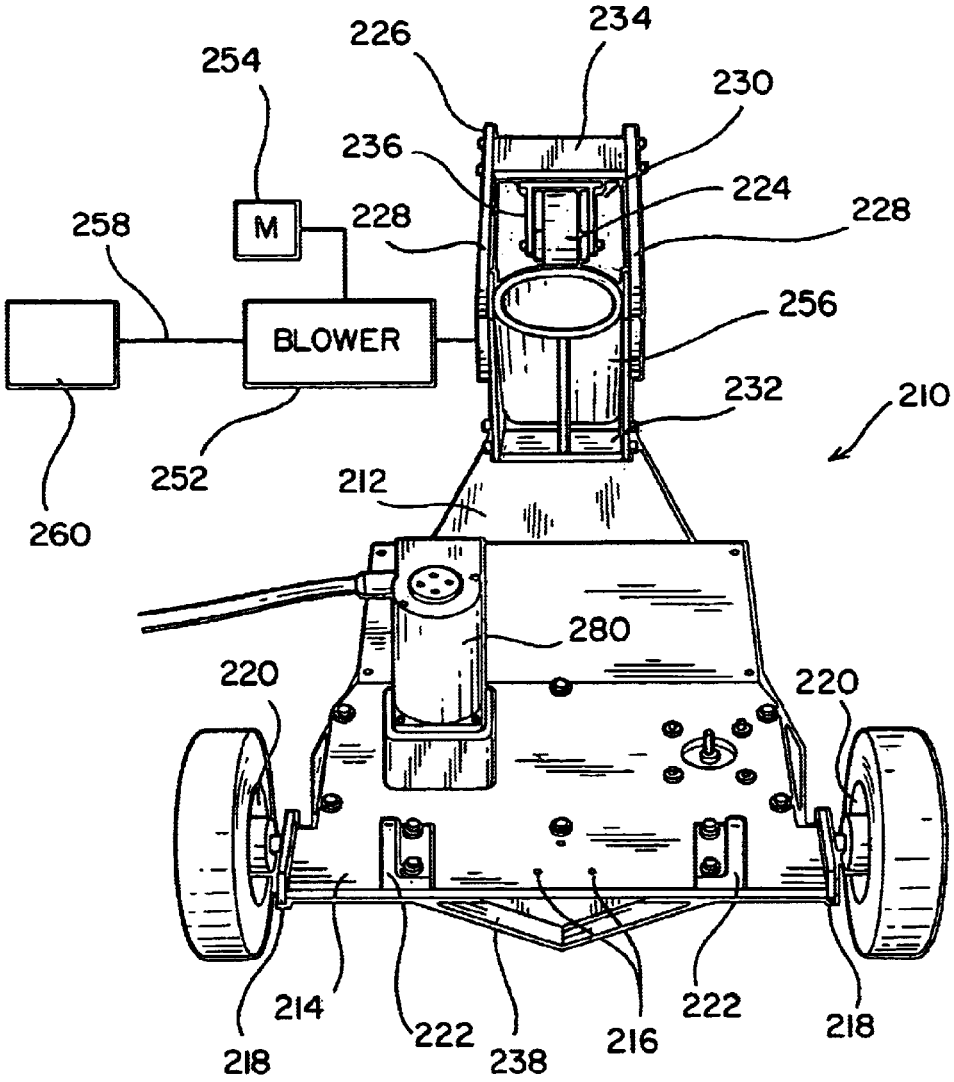
FIG. 3 is a front elevational view of a new and improved device, machine, or apparatus which has been constructed in accordance with the principles and teachings of the present invention for removing the protective covers from the vertically upstanding leg members of the temporary raised pavement markers (TRPM) in order to finally prepare the temporary raised pavement markers (TRPM) for their traffic lane delineation or demarcation functions.
Figure 4:
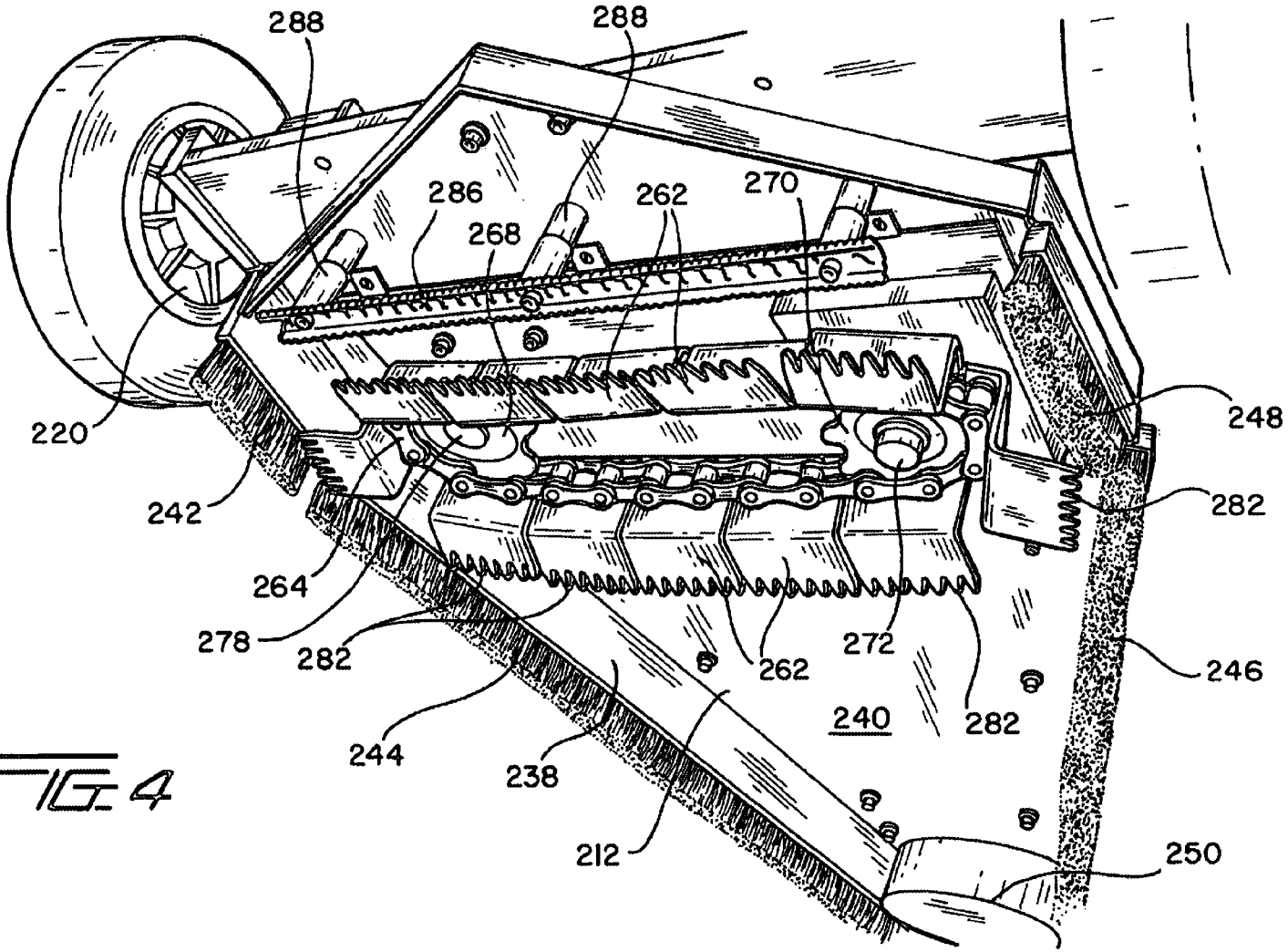
FIG. 4 is a bottom perspective view of the new and improved device, machine, or apparatus of the present invention showing the mounting of the toothed combs, beneath the platform of the machine or apparatus, for engagement with the temporary raised pavement markers (TRPM) in order to remove the protective covers therefrom.
Figure 6:
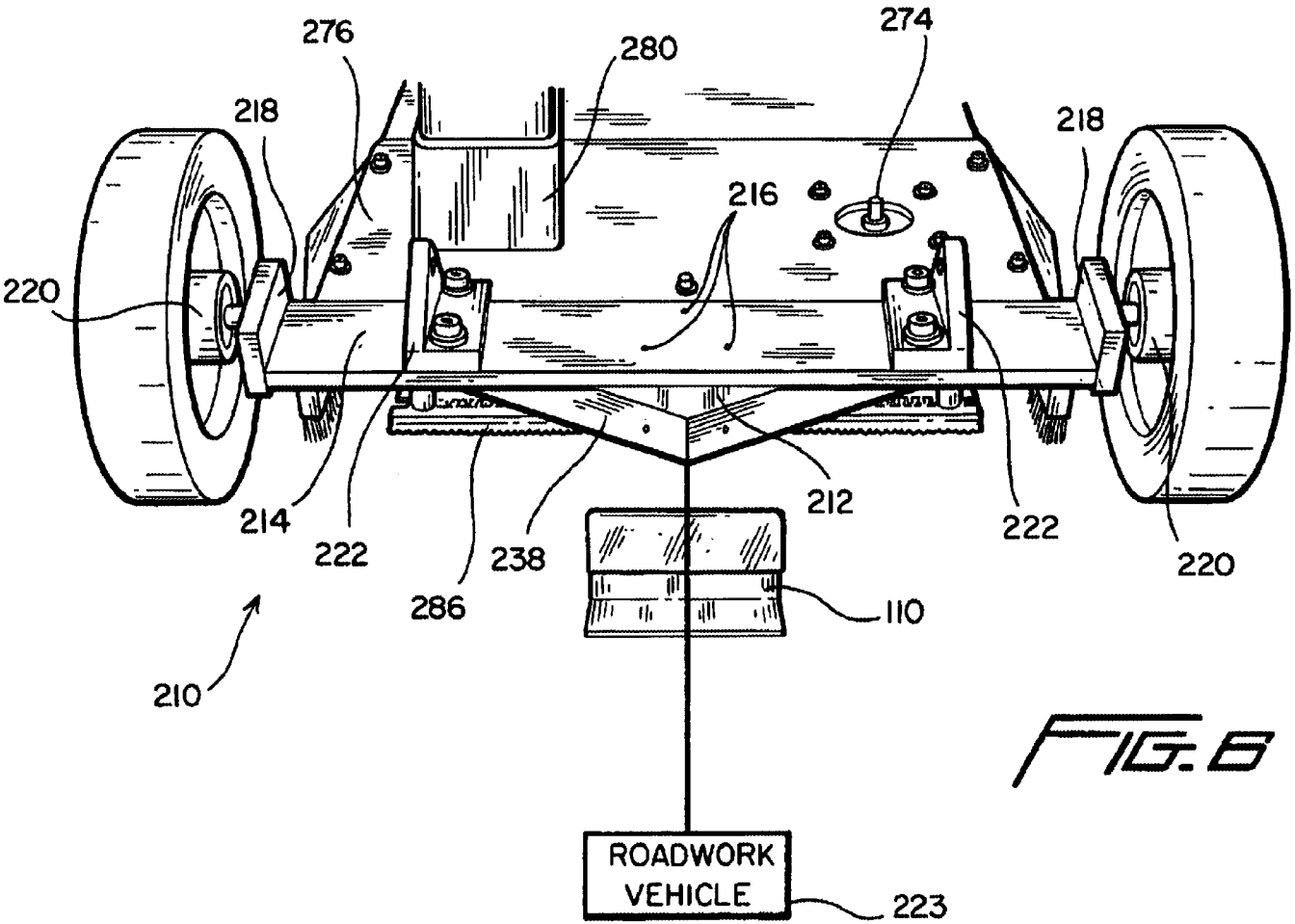
FIG. 6 is a front elevational view of the new and improved machine or apparatus of the present invention as the same approaches a temporary raised pavement marker (TRPM) so as to remove the protective cover therefrom.

Referring now to the drawings, and more particularly to FIGS. 3 and 4 thereof, the new and improved apparatus, machine, or device for automatically removing a protective cover 126 from the vertically upstanding leg member 114 of a temporary raised pavement marker (TRPM), such as that shown at 110 in FIG. 2, is disclosed and is generally indicated by the reference character 210. The apparatus or machine 210 is seen to comprise a horizontally disposed platform 212, and a laterally or transversely extending mounting plate 214 is bolted or riveted, as at 216, to a forward upper surface portion of the platform 212 as best seen in FIG. 6. As can best be seen from FIGS. 3 and 6, opposite ends of the mounting plate 214 have a pair of upstanding mounting brackets 218 integrally formed thereon, and a pair of front wheel assemblies 220,220 are adapted to be rotatably secured to the mounting brackets 218. In addition, a pair of laterally or transversely spaced towing hitch mounting brackets 222,222 are also fixedly secured upon the mounting plate 214 for operative connection to a suitable trailer hitch assembly by means of which the entire machine or apparatus 210 of the present invention can be towed by a roadwork truck or vehicle schematically shown at 223. As best seen in FIG. 3, at the rear end of the machine or apparatus 210, there is provided a single rotatable and steerable wheel assembly 224, and in order to mount the rear wheel assembly 224 upon the machine or apparatus 210, a framework assembly 226 is utilized. The framework assembly 226 is seen to comprise a pair of longitudinally extending, transversely spaced frame members 228, 228 defining an open space 230 therebetween, and it is seen further that forward ends of the frame members 228,228 are fixedly secured to a housing 232 which is fixedly mounted upon a rearward upper surface portion of the platform 212. The rear ends of the frame members 228,228 are connected to opposite sides of a wheel platform 234, and a caster wheel type clevis assembly 236 is rotatably mounted upon an undersurface portion of the wheel platform 234.

Figure 5:
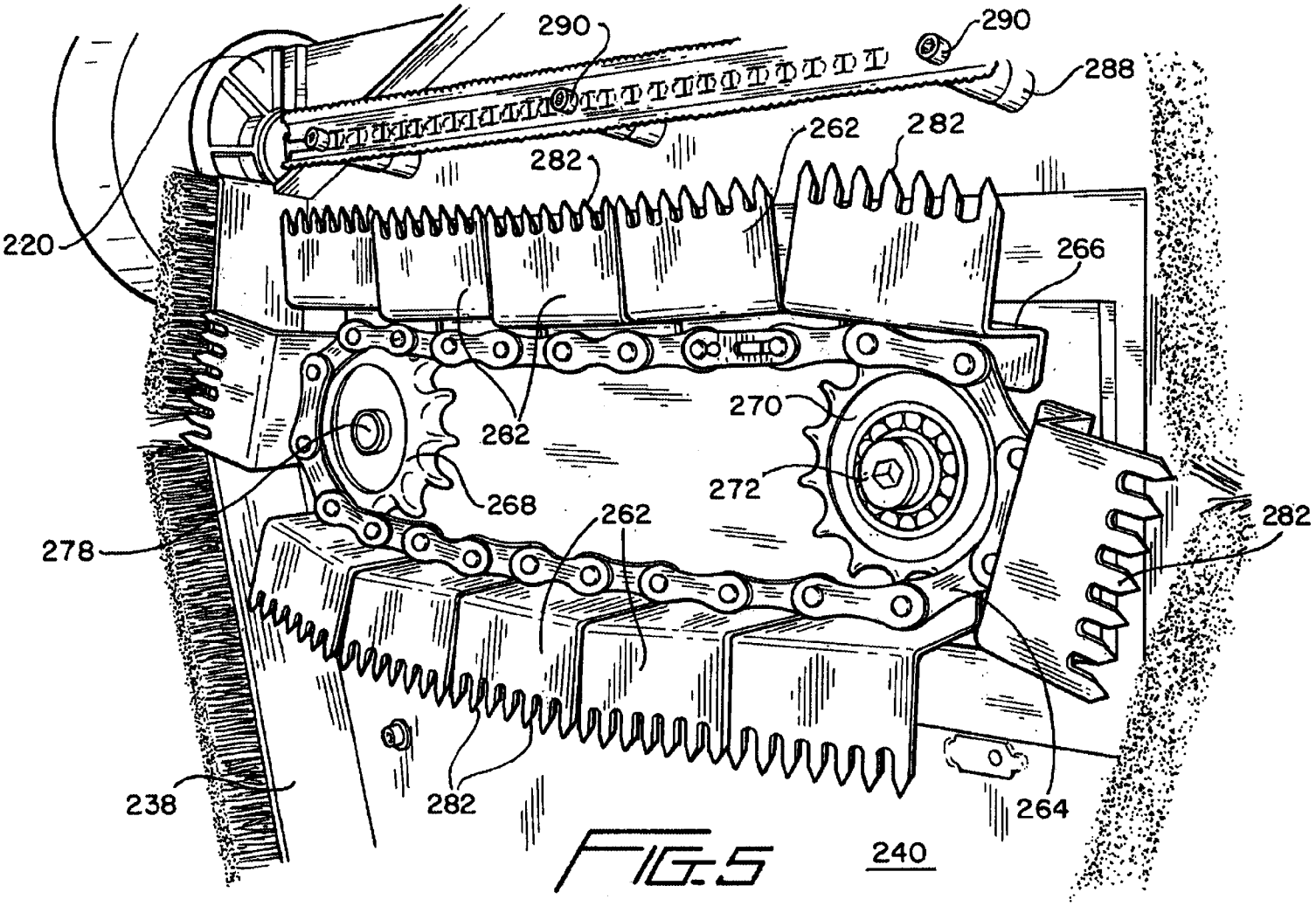
FIG. 5 is an enlarged bottom plan view of the new and improved machine or apparatus of the present invention, as illustrated within FIG. 4, showing the various structural components thereof in greater detail.

As best seen in FIGS. 3–6, the platform 212 has a dependent skirt portion 238 disposed around the entire periphery of the platform 212, and accordingly, the undersurface or bottom interior surface 240 of the platform 212 is recessed as can best be appreciated from FIGS. 4 and 5. In addition, as is also best appreciated from FIG. 4, the platform 212 is seen to have a configuration which is substantially that of an isosceles triangle with the base of the triangle disposed at the front of the machine or apparatus 210 while the substantially equal sides of the triangle converge or taper toward the apex of the triangle which is disposed at the rear of the machine or apparatus 210. A plurality of brushes 242,244,246,248 are dependently secured to the lower edge portion of the skirt 238 of the platform 212 so as to collectively form a brush curtain which is adapted to engage the roadway surface, the brush section operatively associated with the rear apex portion of the platform not being visible.

It is also noted that a suction intake port 250 is defined within the undersurface 240 of the platform 212 at the apex region thereof, and in view of the aforenoted contact engagement of the various brush sections 242–248 with the roadway surface, the brush sections 242–248 effectively define a substantially peripherally sealed recessed region underneath the platform 212. In addition, when suction air is caused to flow into and through the intake port 250, the structural convergence of the triangular sides of the platform 212, and the presence of the dependent peripheral skirt 242 and the collective brush curtain defined by means of the plurality of brushes 242–248 defining the aforenoted peripherally sealed region beneath the platform 212, all combine together to cause debris to be naturally or inherently collected so as to flow toward the intake port 250. In order to achieve such suction air flow through intake port 250, a suction blower 252 is adapted to be mounted upon an upper central surface portion of the platform 212, as schematically illustrated within FIG. 3, and a blower drive motor 254, which may either by gas-powered or electrically-powered, is operatively connected to the blower 252. The intake or suction side of the blower 252 is fluidically connected to the suction or intake port 250 through means of a suction or intake duct 256, and the exhaust side of the blower 252 is fluidically connected to an exhaust duct 258 which may, in turn, be fluidically connected to a suitable collection bin, container, or the like, 260 within which debris can be deposited and collected.

As disclosed within FIGS. 4 and 5, in order to actually achieve the removal of the protective covers 126 from the vertically upstanding leg members 114 of the temporary raised pavement markers (TRPM) 110 when it is desired to effectively remove the protective covers 126, a plurality of comb implements 262 are disposed beneath the undersurface portion 240 of the platform 212. Each one of the comb implements 262 is fixedly mounted upon a sprocket chain 264 by means of an integral mounting bracket section 266, and it is seen that the sprocket chain 264 is operatively disposed or looped around a pair of laterally or transversely separated sprockets 268,270 wherein the sprocket 268 comprises a drive sprocket and the sprocket 270 comprises a driven sprocket, such that the sprocket chain 264 has a substantially oval-shaped configuration. Driven sprocket 270 is fixedly mounted upon the lower end of a rotary shaft 272 which is rotatably mounted within a suitable bearing assembly 274. The bearing assembly 274 is bolted upon a mounting plate 276 which, in turn, is bolted to the upper surface portion of the platform 212, as best seen in FIG. 6. The drive sprocket 268 is similarly mounted upon the lower end of a rotary drive shaft 278 which extends downwardly through the platform 212 from a rotary drive motor 280, which may either be gas-powered or electrically powered, wherein the drive motor 280 is also mounted upon the mounting plate 276 bolted to the upper surface portion of the platform 212. Consequently, operation of the drive motor 280 causes rotation of its drive shaft 278 for, in turn, causing rotation of the drive sprocket 268. Accordingly, rotation of the drive sprocket 268 causes translational movement of the sprocket drive chain 264 and the consequent rotation of the driven sprocket 270, all of such operative components together causing the translational movement of the comb implements 262. Alternative to the provision of the drive motor 280, the wheel assemblies 220,220 may be operatively connected to, for example, the drive sprocket 268 in such a manner that as the apparatus or machine 210 is towed by means of the roadwork service truck or vehicle, not shown, the rotating wheel assemblies 220,220 will cause rotation of the drive sprocket 268 and the consequent rotation of the sprocket chain 264 and the driven sprocket 270. In this manner, the drive motor 280 may be eliminated.

With reference still being made to FIGS. 4 and 5, it is seen further that each one of the comb implements 262 has a plurality of adjacent teeth 282 integrally formed upon free edge portions thereof, the number of teeth 282 being, for example, seven, as illustrated, however, the particular number of teeth 282 may vary. It is also to be noted, as may best be appreciated from FIG. 2, that when the substantially inverted U-shaped protective cover 126 is mounted upon the upper end portion of the vertically upstanding leg member 114 of the temporary raised pavement marker (TRPM) 110, the protective cover 126 is adapted to be simply secured upon the vertically upstanding leg member 114 by means of a staple or other similar type, readily removable fastener 284. Accordingly, the plurality of teeth 282 formed upon the individual comb implements 262 are adapted to effectively engage the staple or other similar fastener 284 fixedly secured within the vertically upstanding leg member 114 of the temporary raised pavement marker (TRPM) 110, remove the staple or fastener 284 from the vertically upstanding leg member 114 of the temporary raised pavement marker (TRPM) 110, and accordingly, the protective cover 126 of the temporary raised pavement marker (TRPM) 110 will be separable from the vertically upstanding leg member 114 of the temporary raised pavement marker (TRPM) 110.

In order to facilitate such a protective cover removal operation, it is further seen, as best illustrated within FIGS. 4–6, that a deflection bar 286 is fixedly mounted upon the undersurface portion 240 of the platform 212 through means of a plurality of cylindrically shaped spacers 288. Suitable bolt fasteners 290 fixedly mount the deflection bar 286 upon the spacers 288, and as a result of such a mounting arrangement, it is seen, as may be best appreciated from FIG. 6, that the deflection bar 286 is disposed at a predetermined elevational level beneath the machine or apparatus 210. Accordingly, as the machine or apparatus 210 approaches a temporary raised pavement marker (TRPM) 110, the deflection bar 286 will engage the resilient vertically upstanding leg member 114 of the temporary raised pavement marker (TRPM) 110 and cause the same to be deflected downwardly into a substantially horizontal orientation such that the comb implements 262, and the teeth elements 282 thereof, can engage the staple or other fastener 284 and thereby effectively remove the same from the vertically upstanding leg member 114 of the temporary raised pavement marker (TRPM) 110 so as to permit separation of the protective cover 126 from the vertically upstanding leg member 114 of the temporary raised pavement marker (TRPM) 110.

In operation, as can be readily appreciated from FIGS. 4–6, when it is desired to remove the protective covers 126 from the plurality of temporary raised pavement markers (TRPM) 110, the machine or apparatus 210 of the present invention is towed behind a roadwork service vehicle or truck, not shown. Accordingly, as the machine or apparatus 210 approaches respective ones of the temporary raised pavement markers (TRPM) 110 as seen in FIG. 6, and in the direction F as shown in FIG. 2*a*, the front end portion of the apparatus or machine 210 will pass over the temporary raised pavement marker (TRPM) 110 whereby the deflection bar 286 will engage the vertically upstanding leg member 114 of the temporary raised pavement marker (TRPM) 110 such that the vertically upstanding leg member 114 will be bent or deflected downwardly as schematically illustrated within FIG. 2*a*. It is to be particularly appreciated at this time that the longitudinal spacing, as considered along the direction of movement of the apparatus or machine 210, and as defined between the deflection bar 286 and the forwardly oriented teeth 282 of the comb implements disposed upon the forward side of the oval-shaped loop of the drive chain 264, will be such that as the deflection bar 286 deflects the vertically upstanding leg member 114 of the temporary raised pavement marker (TRPM) 110 downwardly, and maintains the vertically upstanding leg member 114 of the temporary raised pavement marker (TRPM) 110 in the downwardly disposed position, the forwardly oriented teeth 282 of one or more of the comb implements 262 will engage what is now the upper surface of the downwardly deflected leg member 114 of the temporary raised pavement marker (TRPM) 110 and effectively enter and be inserted into the space 292 defined between the upper surface portion of the downwardly deflected leg member 114 of the temporary raised pavement marker (TRPM) 110 and the trailing edge portion of what is now the upper leg member of the U-shaped protective cover 126.

Therefore, as the machine or apparatus continues to move forwardly in the direction F, the teeth 282 of the comb implements 262 will engage the stapled or fastened portion 284 of the protective cover 126, the teeth 282 of the comb implements 262 will cause the staple or fastener 284 to be removed from its secured state within the downwardly deflected leg member 114 of the temporary raised pavement marker (TRPM) 110, and accordingly, the protective cover 126 is now no longer fixedly secured to the downwardly deflected leg member 114 of the temporary raised pavement marker (TRPM) 110. As the toothed comb implements 262 continue to be moved transversely in accordance with the movement of the drive chain 264 as the machine or apparatus 210 continues to move forwardly, the protective cover 126 is in fact separated from its previously associated temporary raised pavement marker (TRPM) 110 and carried or transported toward the rear section of the toothed comb assembly whereby it will fall off the now rearwardly disposed comb implements 262. In view of the fact that the suction blower 252 has also been actuated at this point in time, the converging sides of the skirt portion 238 of the platform 212 and the correspondingly convergent disposition of the brushes 244,246, as well as the suction air flow within the recessed region beneath the undersurface portion 240 of the platform 212, will together cause the separated protective covers 126 to be collected and conducted toward the suction intake port 250 for discharge through the blower exhaust duct 258 and into the collection bag or container 260.

It is noted that if the protective cover 126, which is now separated from the temporary raised pavement marker (TRPM) 110 and is disposed upon one or more of the comb implements 262, does not readily become separated from the rearwardly disposed comb implements 262 so as to be disposed within the recessed region beneath the platform 212, a suitable stripper implement, not shown, can be operatively mounted upon, for example, the undersurface 240 of the platform 212 so as to positively assist the separation or drop-off of the protective cover 126 from the comb implements 262. It is noted still further that as the apparatus or machine 210 continues its forward movement so as to entirely pass over the particular temporary raised pavement marker (TRPM) 110, the resiliency inherent within the temporary raised pavement marker (TRPM) 110 permits the vertically upstanding leg member 114 thereof to regain its vertical orientation, thereby effectively presenting itself for its service or function as a temporary raised pavement traffic lane marker.

Thus, it may be seen that in accordance with the principles and teachings of the present invention, there has been disclosed a new and improved machine for automatically removing the protective coverings from temporary raised pavement markers (TRPM) which have been previously mounted upon roadway surfaces wherein a platform has a motor mounted thereon for driving a plurality of comb implements which have teeth integral therewith for engaging the protective coverings of the temporary raised pavement markers (TRPM). The comb implements are are mounted beneath the platform, and a blower is fluidically connected to a suction port defined within a rear section of the platform. Accordingly, as the comb implements remove the protective coverings from the temporary raised pavement markers (TRPM), the suction blower exhausts the removed debris and conducts the same toward a collection bin or bag. As a result of such apparatus, the protective coverings are able to be automatically removed from the temporary raised pavement markers (TRPM) without requiring manual operations by operator personnel so as not to expose operator personnel to unnecessary dangers inherently present from vehicular traffic on the roadways.

Obviously, many variations and modifications of the present invention are possible in light of the above teachings. It is therefore to be understood that within the scope of the appended claims, the present invention may be practiced otherwise than as specifically described herein.

What is claimed as new and desired to be protected by Letters Patent of the United States of America, is:

1. Apparatus, adapted to be attached to a roadwork vehicle so as to be movable along with the roadwork vehicle as the roadwork vehicle moves over a roadway surface, for automatically removing protective coverings from the normally vertically upstanding leg members of flexible pavement markers secured to a roadway surface, comprising:

a platform;

at least one toothed implement mounted beneath said platform so as to be located at a predetermined position above the roadway surface so as not to be engaged with the roadway surface and yet be engageable with the protective coverings of the pavement markers fixedly mounted upon the roadway surface so as to remove the protective coverings from the pavement markers as the roadwork vehicle moves over a roadway surface;

an exhaust port defined within said platform through which removed pavement marker protective covering debris can be exhausted; and a suction blower mounted upon said platform and fluidly connected to said exhaust port so as to exhaust pavement marker protective covering debris removed by said at least one toothed implement.

2. The apparatus as set forth in claim 1, wherein:

a drive motor, having a drive output shaft, is mounted upon said platform;

a drive sprocket is mounted upon said drive output shaft of said drive motor;

a driven sprocket is rotatably mounted upon said platform; and said at least one toothed implement comprises a plurality of toothed implements fixedly mounted upon a drive chain operatively engaged with said drive and driven sprockets.

3. The apparatus as set forth in claim 2, wherein:

said platform has a configuration which is substantially that of an isosceles triangle wherein the base portion of said isosceles triangle is located at the forward end of said platform as considered in the direction of movement of said apparatus along the roadway surface, and the side portions of said isosceles triangle converge toward the rear apex end of said platform;

said plurality of toothed implements, said drive and driven sprockets, and said drive chain are disposed beneath said forward end of said platform; and said exhaust port is defined within said rear end of said platform.

4. The apparatus as set forth in claim 3, further comprising:

brush means dependently supported from said platform in a substantially peripheral array around said platform for engaging the roadway surface so as to effectively form a substantially sealed region beneath said platform whereby removed pavement marker protective covering debris is effectively contained within said substantially sealed region so as to facilitate the exhaust thereof through said exhaust port.

5. The apparatus as set forth in claim 3, further comprising:

brush means dependently supported from said platform in a substantially peripheral array around said platform for engaging the roadway surface so as to effectively form a substantially sealed region beneath said platform whereby as said apparatus is moved along the roadway surface along with the roadwork vehicle, those sections of said brush means disposed along said convergent sides of said triangular platform will tend to funnel removed pavement marker protective covering debris toward said exhaust port.

6. The apparatus as set forth in claim 1, further comprising:

a deflection bar mounted beneath said platform for engaging the normally vertically upstanding leg member of the pavement marker upon which the protective covering is mounted so as to deflect the normally vertically upstanding leg member of the pavement marker to a substantially horizontal position at which said at least one toothed implement can engage the protective covering of the pavement marker so as to remove the protective covering from the pavement marker.

7. The apparatus as set forth in claim 3, further comprising:

a at least one wheel assembly rotatably mounted upon said platform for rollably supporting said platform upon the roadway surface upon which the plurality of pavement markers, from which the protective coverings are to be removed, are disposed.

8. The apparatus as set forth in claim 7, wherein:

said at least one wheel assembly rotatably mounted upon said platform comprises a pair of laterally spaced wheel assemblies mounted upon said forward base end of said platform, and a single steerable wheel assembly mounted upon said rear apex end of said platform.

9. The apparatus as set forth in claim 3, further comprising:

trailer hitch means mounted upon said forward base end of said platform for attaching said platform to the roadwork vehicle.

10. In combination, apparatus, adapted to be attached to a roadwork vehicle so as to be movable along with the roadwork vehicle as the roadwork vehicle moves over a roadway surface, for automatically removing protective coverings from the normally vertically upstanding leg members of flexible pavement markers fixedly secured upon a roadway surface, comprising:

a roadwork vehicle;

a platform attached to said roadwork vehicle;

at least one toothed implement mounted beneath said platform so as to be located at a predetermined position above the roadway surface so as not to be engaged with the roadway surface and yet be engageable with the protective coverings of the pavement markers fixedly mounted upon the roadway surface so as to remove the protective coverings from the pavement markers as said roadwork vehicle moves over a roadway surface;

an exhaust port defined within said platform through which removed pavement marker protective covering debris can be exhausted; and a suction blower mounted upon said platform and fluidly connected to said exhaust port so as to exhaust pavement marker protective covering debris removed by said at least one toothed implement.

11. The combination as set forth in claim 10, wherein:

a drive motor, having a drive output shaft, is mounted upon said platform;

a drive sprocket is mounted upon said drive output shaft of said drive motor;

a driven sprocket is rotatably mounted upon said platform; and said at least one toothed implement comprises a plurality of toothed implements fixedly mounted upon a drive chain operatively engaged with said drive and driven sprockets.

12. The combination as set forth in claim 11, wherein:

said platform has a configuration which is substantially that of an isosceles triangle wherein the base portion of said isosceles triangle is located at the forward end of said platform as considered in the direction of movement of said apparatus along the roadway surface, and the side portions of said isosceles triangle converge toward the rear apex end of said platform;

said plurality of toothed implements, said drive and driven sprockets, and said drive chain are disposed beneath said forward end of said platform; and said exhaust port is defined within said rear end of said platform.

13. The combination as set forth in claim 12, further comprising:

brush means dependently supported from said platform in a substantially peripheral array around said platform for engaging the roadway surface so as to effectively form a substantially sealed region beneath said platform whereby removed pavement marker protective covering debris is effectively contained within said substantially sealed region so as to facilitate the exhaust thereof through said exhaust port.

14. The combination as set forth in claim 12, further comprising:

brush means dependently supported from said platform in a substantially peripheral array around said platform for engaging the roadway surface so as to effectively form a substantially sealed region beneath said platform whereby as said apparatus is moved along the roadway surface along with said roadwork vehicle, those sections of said brush means disposed along said convergent sides of said triangular platform will tend to funnel removed pavement marker protective covering debris toward said exhaust port.

15. The combination as set forth in claim 10, further comprising:

a deflection bar mounted beneath said platform for engaging the normally vertically upstanding leg member of the pavement marker upon which the protective covering is mounted so as to deflect the normally vertically upstanding leg member of the pavement marker to a substantially horizontal position at which said at least one toothed implement can engage the protective covering of the pavement marker so as to remove the protective covering from the pavement marker.

16. The combination as set forth in claim 12, further comprising:

at least one wheel assembly rotatably mounted upon said platform for rollably supporting said platform upon the roadway surface upon which the plurality of pavement markers, from which the protective coverings are to be removed, are disposed.

17. The combination as set forth in claim 16, wherein:

said at least one wheel assembly rotatably mounted upon said platform comprises a pair of laterally spaced wheel assemblies mounted upon said forward base end of said platform, and a single steerable wheel assembly mounted upon said rear apex end of said platform.

18. The combination as set forth in claim 12, further comprising:

trailer hitch means mounted upon said forward base end of said platform for attaching said platform to said roadwork vehicle.

19. A method of automatically removing substantially U-shaped protective coverings from normally vertically oriented upstanding leg members of flexible pavement markers, comprising the steps of:

attaching a wheeled vehicle to a roadwork vehicle such that said wheeled vehicle is movable over a roadway surface, upon which a plurality of flexible pavement markers are disposed, along with the roadwork vehicle;

providing a platform upon said wheeled vehicle;

providing an exhaust port within said platform through which removed pavement marker protective covering debris can be exhausted;

mounting a suction blower upon said platform and fluidly connecting said suction blower to said exhaust port so as to exhaust pavement marker protective covering debris removed from the pavement markers; and mounting at least one toothed implement beneath said platform such that said least one toothed implement is disposed at a predetermined position above the roadway surface so as not to be engaged with the roadway surface and yet be engageable with the protective coverings of the pavement markers fixedly mounted upon the roadway surface so as to thereby remove the protective coverings from the pavement markers as the wheeled vehicle is moved over the roadway surface along with the roadwork vehicle.

20. The method as set forth in claim 19, further comprising the step of:

mounting a deflection bar beneath said platform so as to engage the normally vertically upstanding leg member of each pavement marker, upon which the protective covering is mounted, and thereby deflect the normally vertically upstanding leg member of the pavement marker to a substantially horizontal position at which said at least one toothed implement can engage the protective covering of the pavement marker so as to remove the protective covering from the pavement marker as the wheeled vehicle is moved over the roadway surface along with the roadwork vehicle.

21. Apparatus for automatically removing protective coverings from the normally vertically upstanding leg members of flexible pavement markers secured to a roadway surface, comprising:

means for attaching said apparatus to a roadwork vehicle so as to be movable along with the roadwork vehicle as the roadwork vehicle moves over a roadway surface; and an implement disposed upon said apparatus so as to be located at a predetermined position above the roadway surface so as not to engage the roadway surface and yet be engageable with the protective coverings of the pavement markers fixedly mounted upon the roadway surface in order to remove the protective coverings from the pavement markers as the roadwork vehicle moves over a roadway surface.

22. In combination, apparatus, adapted to be attached to a roadwork vehicle so as to be movable along with the roadwork vehicle as the roadwork vehicle moves along a roadway surface, for automatically removing protective coverings from the normally vertically upstanding leg members of flexible pavement markers secured to a roadway surface, comprising:

a roadwork vehicle;

means for attaching said apparatus to said roadwork vehicle so as to be movable along with said roadwork vehicle as said roadwork vehicle moves over a roadway surface; and an implement disposed upon said apparatus so as to be located at a predetermined position above the roadway surface so as not to engage the roadway surface and yet be engageable with the protective coverings of the pavement markers fixedly mounted upon the roadway surface in order to remove the protective coverings from the pavement markers as said roadwork vehicle moves over a roadway surface.

23. A method of automatically removing substantially U-shaped protective coverings from normally vertically oriented upstanding leg members of flexible pavement markers, comprising the steps of:

attaching a wheeled vehicle to a roadwork vehicle such that said wheeled vehicle is movable over a roadway surface, upon which a plurality of flexible pavement markers are disposed, along with the roadwork vehicle; and mounting an implement upon said wheeled vehicle such that said implement is located at a predetermined position above the roadway surface so as not to engage the roadway surface and yet be engageable with the protective coverings of the pavement markers fixedly mounted upon the roadway surface in order to remove the protective coverings from the pavement markers as the roadwork vehicle moves over a roadway surface.

* * * * *